US006286699B1

(12) United States Patent
Sudo

(10) Patent No.: US 6,286,699 B1
(45) **Date of Patent: *Sep. 11, 2001**

(54) LAMINATED RUBBER STOPPER

(75) Inventor: Morihiro Sudo, Sumida-ku (JP)

(73) Assignee: Daikyo Seiko, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/665,371

(22) Filed: Jun. 19, 1996

(51) Int. Cl.[7] ..... B65D 39/00; B65D 39/18
(52) U.S. Cl. ..... 215/364; 215/247; 220/801
(58) Field of Search ..... 215/364, 355, 215/247, 358, 362; 220/801, 802

(56) References Cited

U.S. PATENT DOCUMENTS

| | | | | |
|---|---|---|---|---|
| 1,721,210 | * | 7/1929 | Dalley | 215/364 X |
| 2,573,637 | * | 10/1951 | Bender | 215/364 X |
| 3,842,790 | * | 10/1974 | Clark | 215/364 |
| 4,441,621 | | 4/1984 | Matukura et al. . | |
| 4,554,125 | * | 11/1985 | Knapp | 215/364 X |
| 5,288,560 | * | 2/1994 | Sudo et al. | 215/364 |

FOREIGN PATENT DOCUMENTS

| | | |
|---|---|---|
| 1012842 | 7/1957 | (DE) . |
| 1039390 | 9/1958 | (DE) . |
| 0294127 | 12/1988 | (EP) . |
| 0324554 | 7/1989 | (EP) . |
| 738546 | 10/1955 | (GB) . |
| 58-29939 | 2/1983 | (JP) . |

* cited by examiner

*Primary Examiner*—Gregory M. Vidovich
*Assistant Examiner*—Niki M. Eloshway
(74) *Attorney, Agent, or Firm*—Wenderoth, Lind & Ponack, L.L.P.

(57) ABSTRACT

A laminated rubber stopper having a new structure, capable of being produced in a simple process with a reduced production cost and being excellent in tightness, sealing property and sanitary property, is provided, comprising a top part having a flange part and a leg part provided under the top part of the rubber stopper and to be inserted into the mouth part of a vial, at least a surface thereof to be contacted with a contents in the vial being laminated with a fluoro resin film, in which the lower surface of the flange part has an annular concavity with a cross section of a circular arc from the periphery of the flange to the neck part.

6 Claims, 4 Drawing Sheets

LAMINATED RUBBER STOPPER

BACKGROUND OF THE INVENTION

1. Field of the Invention

This invention relates to a novel structure of laminated rubber stopper and more particularly, it is concerned with a laminated rubber stopper used for sealing containers, instruments, etc. for medicaments and medical treatments.

2. Description of the Prior Art

As a stopper material of a container, instrument, etc. for medicaments and medical treatments, it is desired to have various properties such as heat resistance, compression resistance test, softness, chemical inertness and low permeability of gases or water. In particular, rubbers are excellent in sealing property and natural rubbers have been used for a long time while synthetic rubbers have often been used more recently for example, isobutylene-isoprene co-polymer rubbers (IIR) having been recommended from a sanitary point of view. However, these materials have such problems as contamination in that curing agents, compounding agents, etc. contained in rubbers are dissolved in medicaments held in containers, the contents in a container are adsorbed on the rubber surface, fine grains occur from the rubber material during the production process or storage, etc.

In order to solve these problems, a laminated rubber stopper has been proposed in which a part of the rubber stopper, to be contacted with a contents in a container, or the whole surface of a leg part is laminated with a chemically inert resin such as fluoro resins. The contamination due to contact of a liquid medicament, etc., with a rubber surface can be prevented by the laminated rubber stopper, but in fact, such a proposal cannot be applied to preparation of drugs since there arise new problems that the leg part of the stopper laminated with a fluoro resin, etc. is inferior in sealing property of the mouth part of a vial to that having a rubber surface exposed and preparation of a thin laminated layer capable of maintaining rubber elasticity is difficult.

As shown in FIG. 5, on the other hand, the inventor has proposed a laminated rubber stopper capable of preventing the contamination by forming a laminated layer of a fluoro resin film on a leg part, while maintaining the tightness or sealing property with a container by retaining an exposed rubber surface on an area from the lower surface of a flange part in the top part of a rubber stopper body to the base of the leg part (Japanese Patent Publication No. 64062/1993), and a production process for realizing this structure (Japanese Patent Publication No. 50386/1993).

The above described laminated rubber stopper the inventor has proposed is an excellent rubber stopper capable of realizing the desired effects, but this cannot be said to be suitable for application to a container for a very unstable and expensive medicament, for example, biotechnological preparations, anticancer drugs, etc., which have lately been developed, since a rubber surface is contacted with a lip part of a container although it is not contacted with a liquid medicament. For the production thereof, a complicated process is required the stopper, using upper and lower metallic molds, thus increasing the production cost.

SUMMARY OF THE INVENTION

It is an object of the present invention to provide a laminated rubber stopper with a new structure or shape, whereby the disadvantages of the prior art can be overcome.

It is another object of the present invention to provide a laminated rubber stopper having a new structure, capable of being produced in a simple process with a reduced production cost and being so excellent in tightness, sealing property and sanitary property that the rubber stopper can be used in a storage container for unstable and expensive medicaments sensitive to the outside environment, with maintaining its good quality for a long time.

These objects can be attained by a laminated rubber stopper comprising a top part having a flange part and a leg part provided under the top part of the rubber stopper and to be inserted into the mouth part of a vial, at least a surface thereof to be contacted with the contents in the vial being laminated with a fluoro resin film, in which the lower surface of the flange part has an annular concavity with a cross-section of an arc from the periphery of the flange to the neck part (connection part with the leg part).

BRIEF DESCRIPTION OF THE DRAWINGS

The accompanying drawings illustrate the principle and merits of the present invention in greater detail.

DETAILED DESCRIPTION OF THE INVENTION

The inventor has found that a laminated rubber stopper having sealing property comparable to that of the prior art laminated rubber stopper, having, an exposed rubber surface retained in part, described in the foregoing Japanese Patent Publication, can be obtained by devising the shape of the rubber stopper itself, even if the whole lower surface of the rubber stopper, including the lower surface of the flange in the top part and the whole surface of the leg part, is laminated, and has thus reached the present invention. In addition, it is found that the sealing property is further improved by applying this new shape of the rubber stopper of the present invention to the prior art rubber stopper of such a type that the base of the leg part and the lower surface of the flange part are not laminated but are retained as an exposed rubber surface.

That is, the present invention provides (1) a laminated rubber stopper comprising a top part having a flange part and a leg part provided under the top part of the rubber stopper and to be inserted into the mouth part of a vial, at least a surface thereof to be contacted with the contents in the vial being laminated with a fluoro resin film, in which the lower surface of the flange part has an annular concavity with a cross section of an arc from the periphery of the flange to the neck part, (2) the laminated rubber stopper as described in the above (1), wherein the whole surface of the leg part is laminated except the periphery of the base thereof and the lower surface of the flange part has an annular concavity with a cross section of an arc from the periphery of the flange to the neck part, (3) the laminated rubber stopper as described in the above (1), wherein at least the whole of the lower surface side of the rubber stopper is laminated with a fluoro resin film and the lower surface of the flange part has an annular concavity with a cross-section of an arc from the periphery of the flange to the neck part, (4) the laminated rubber stopper as described in any one of the above (1) to (3), wherein the annular concavity with a cross-section of an arc has an R of 0.05 to 0.5 mm in radius of curvature, and (5) the laminated rubber stopper as described in any one of the above (1) to (3), wherein the neck part has an R of 0.01 to 0.4 mm in radius of curvature.

Figure 1A:
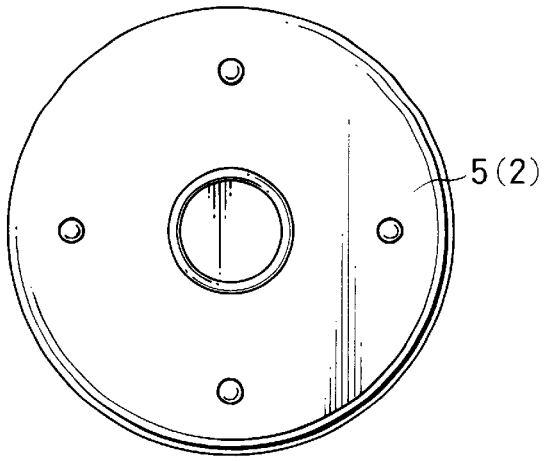
FIG. 1 (A), (B) and (C) are respectively a top view, cross-sectional view and bottom view of one embodiment of a laminated rubber stopper of the present invention.
Figure 1B:
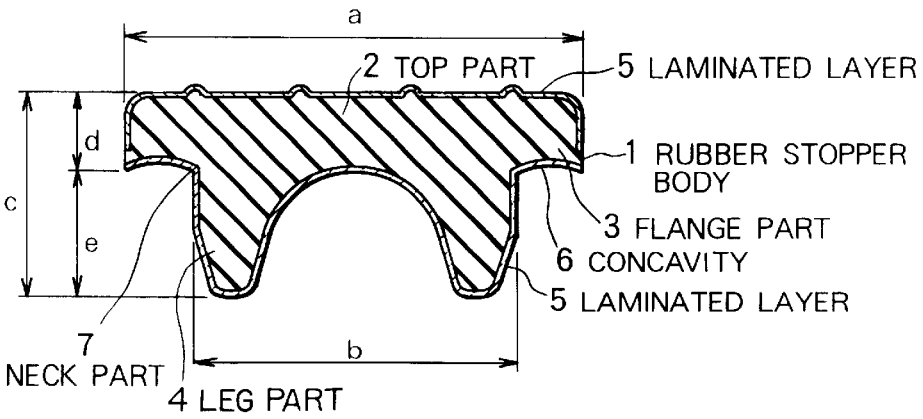
Figure 1C:
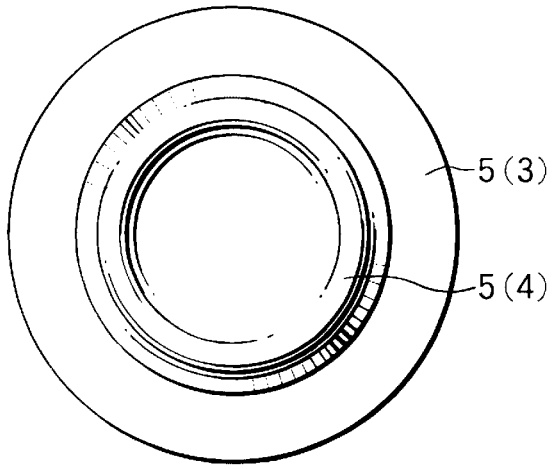
Figure 2:
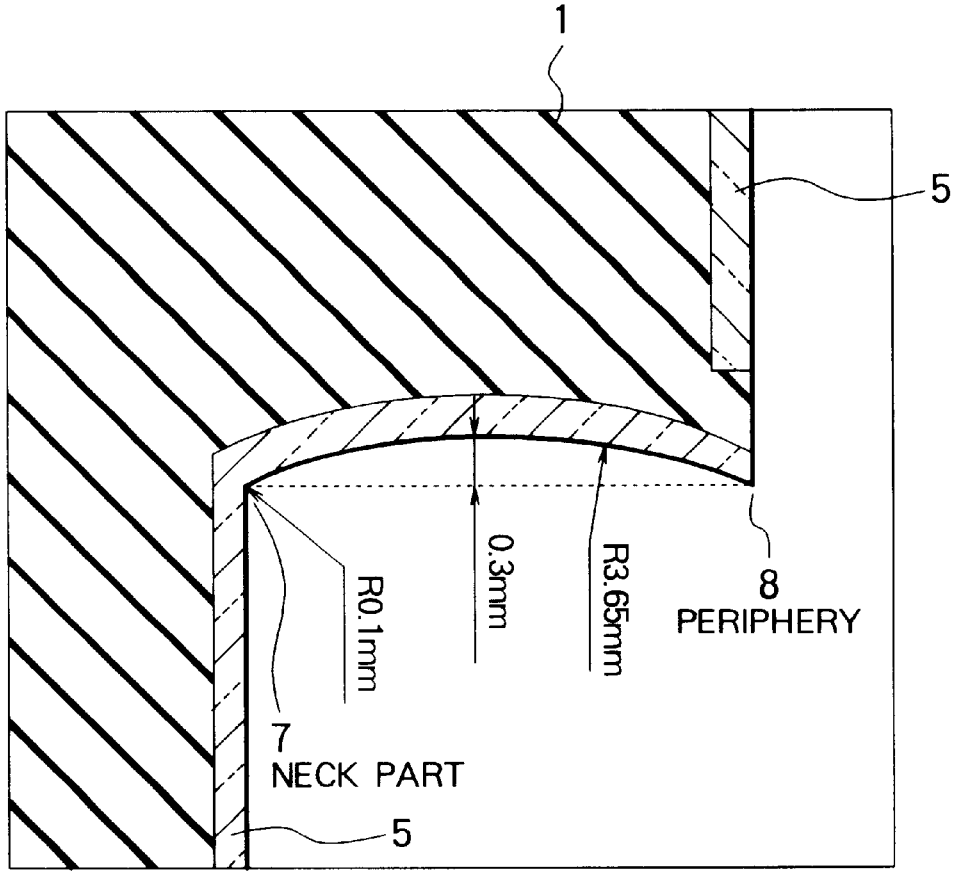
FIG. 2 is a partially enlarged cross-sectional view of (B) of FIG. 1.

FIG. 1 (B) is a cross-sectional view of one embodiment of the present invention, in which a rubber stopper body 1 is composed of a top part 2 having a flange part 3 and a leg part 4 to be inserted into a vial and the whole of the lower surface of the rubber stopper, i.e. the whole surface of from the lower surface of the flange 3 to the leg part 4 is laminated with a layer of a fluoro resin film 5. On the lower surface of the flange part 3 for covering the mouth part of a vial is formed "an annular concavity with a cross-section of an arc 6", which will hereinafter be referred to as "the concavity", from the periphery of the flange 3 to the neck part 7 with the leg part 4, as shown in FIG. 1. When the rubber stopper is inserted into the vial, the peripheral edge of a lip portion of the vial fits between the base of the leg part in the rubber stopper, i.e. having the neck part 7 as a common boundary with the lower surface of the flange, and the periphery 8 of the flange 3 as shown in FIG. 1 or FIG. 2 by the presence of the concavity 6, and any defect in the surface precision on the peripheral edge of a lip portion of the vial is absorbed by the presence of the concavity 6 to result in close contact and sealing.

In the present invention, furthermore, it is desired that R provided in the cross-section of the neck part 7 as the boundary of the base of the leg part and the lower surface of the flange part is rendered smaller than that of the prior art, so as to further improve the adaptability to the peripheral edge of a lip portion of the vial and increase the air-tightness.

In the laminated rubber stopper of the present invention, at least the surface of the rubber stopper to be contacted with the contents in a vial is laminated with a fluoro resin film and the tightness with a vial is largely. improved, as described above, to increase the storage property of the contents in the vial by devising the shape of the lower surface of the flange and optionally retaining a range of area from the base of the leg part to the lower surface of the flange as an exposed rubber surface. In the case of wholly laminating the lower surface of the rubber stopper but retaining an exposed rubber surface on only the base of the leg part, the advantages of the present invention can similarly be realized.

Even in the case of laminating the whole of the lower surface of the rubber stopper, the sealing property which has hitherto not been attained by the prior art rubber stopper whose lower surface is wholly laminated can be realized according to the present invention, and since all the parts of the rubber stopper in contact with a vial, from the peripheral edge of a lip portion of the vial to an inner wall at the mouth part of the vial, and all the parts of the rubber stopper in contact with a medicament liquid, etc., are completely laminated in the present invention, there is no fear of contamination due to exposed rubber surface. Provision of a laminated layer on the upper surface side of the rubber stopper is of course included in the present invention.

Production of the laminated rubber stopper can generally be carried out by using a metallic mold for forming the lower surface of the top part, in which a concavity corresponding to the above described cross-sectional shape is formed, in the process described in, for example, Japanese Patent Publication No. 50386/1993, thus obtaining a laminated rubber stopper having exposed rubber surfaces retained on the base of the leg part and lower surface of the flange.

On the other hand, the rubber stopper of the present invention, having laminated layers continuously from the lower surface of the flange to the whole surface of the leg part, can generally be produced by using a lower metallic mold for forming a lower surface of a top part (lower surface of flange) and a leg part, in which R corresponding to the above described cross-sectional shape is previously formed, arranging a rubber raw material laminated with a fluoro resin film on the lower metallic mold, arranging, on the other hand, a non-laminated rubber material or laminated rubber material on an upper metallic mold corresponding to the shape of the upper surface of the top part and subjecting the resulting assembly of the upper and lower metallic molds to compressing and molding in one stage.

In the laminated rubber stopper of the present invention, as the annular concavity having a cross-section of an arc on the lower surface of the flange part, R in the cross-section preferably has a curvature radius of 0.05 to 0.5 mm, more preferably 0.1 to 0.33 mm, most preferably 0.15 to 0.20 mm.

R of the neck part as the boundary of the flange part and leg part has a radius of curvature of preferably smaller than that of 1.5 to 0.5 mm in the prior art, more preferably at most ⅓ of that of the prior art, most preferably a radius of curvature of 0.01 to 0.4 mm.

As the rubber material for the laminated rubber stopper of the present invention, there are used, without limiting the same, for example, isobutylene-isoprene copolymer rubbers (IIR), chlorinated rubbers of IIR, brominated rubbers of IIR, isobutylene-isoprene-divinylbenzene ternary copolymer rubbers.

Examples of the fluoro resin used in the present invention include tetrafluoroethylene resins, trifluorochloroethylene resins, tetrafluoroethylene-hexafluoropropylene copolymer resins, vinylidene fluoride resins, vinyl fluoride resins, tetrafluoroethylene-ethylene copolymer resins (ETFE), trifluorochloroethylene-ethylene copolymer resins and the like. The thickness of the laminated layer is, for example, 0.01 to 0.2 mm.

Production of the laminated rubber stopper of the present invention can be carried out by other processes in addition to the above described process, for example, comprising subjecting to compressing, crosslinking and molding by the use of upper and lower metallic molds having the specified shape according to the present invention, a non-vulcanized rubber sheet to the surface of which fluoro resin fine powder is allowed to adhere or a non-vulcanized rubber sheet which is coated with or immersed in a solution of a fluoro resin, followed by drying.

The following examples are given in order to illustrate the invention without limiting the same.

EXAMPLE 1

A laminated rubber stopper for a vial according to the present invention was prepared as shown in FIG. 1 (A), (B) and (C) being respectively a top view, cross-sectional view and bottom view of a laminated rubber stopper of the present invention. Referring to FIG. 1, *a* to *e* show a dimension of the rubber stopper, i.e. a 19.0 mm, b 13.2 mm, c 8.5 mm, d 3.0 mm and e 5.5 mm. FIG. 2 is a partially enlarged cross-sectional view of (B) of FIG. 1. In this Example, a body of a rubber stopper 1 was formed of IIR, the cross-section of the lower surface of a flange part 3 was moderately curved with a curvature radius of 3.65 mm and the thickest part of an annular concavity 6 had a depth of 0.3 mm. The curvature radius of the cross-section at a neck part 7, in contact with the base of a leg part 4 was 0.1 mm. In FIG. 1, 5 designates a laminated layer consisting of a fluoro resin film (ETFE) with a thickness of 0.05 mm from the periphery side of the flange over the whole lower surface of the rubber stopper. A top surface side 2 was also laminated with the same resin film with a concave portion showing an injection needle piercing area.

Each of one hundred laminated rubber stoppers of this Example was inserted into a vial with a mouth inner diameter (central value) of 12.3 mm, 12.5 mm and 12.7 mm and subjected to an air-leakage test (vacuum retention test). The results (average value of one hundred samples) are shown in Table 1

Air-leakage Test (vacuum retention test)

The Zero adjust button of an electronic digital manometer is adjusted to +0 Torr. A rubber stopper sample is half-inserted into the mouth of an empty vial under such a state that the leg part is inserted into the vial mouth to such an extent that air in the vial can flow outward and be charged in a vacuum chamber. When the vacuum chamber is evacuated by a vacuum pump and maintained for 3 seconds, the rubber stopper is completely inserted into the vial. The injection needle piercing area of the stopper completely inserted in the vial by an injection needle connected with the electronic digital manometer and the vacuum degree in the vial is measured, during which the vacuum degree immediately after inserting and after passage of a predetermined time is compared to estimate the retention of vacuum. In this Example, when the difference in vacuum degree between immediately after inserting and after passage of 24 hours is less than 200 Torr, the retention of vacuum is judged as "good", i.e. no leak.

Comparative Example 1

Figure 3A:
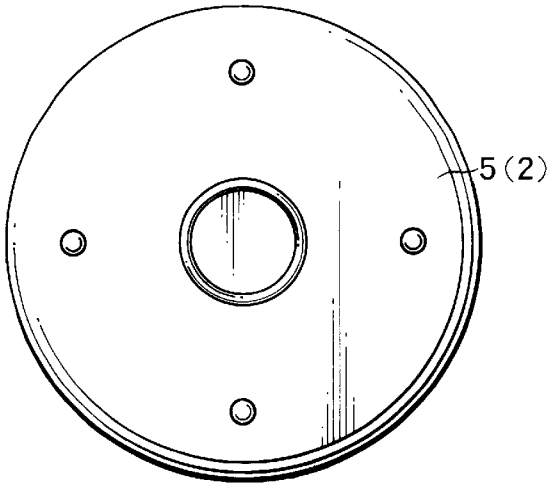
FIG. 3A PRIOR ART
FIG. 3 (A), (B) and (C) are respectively a top view, cross-sectional view and bottom view of a laminated rubber stopper of the prior art.
Figure 3B:
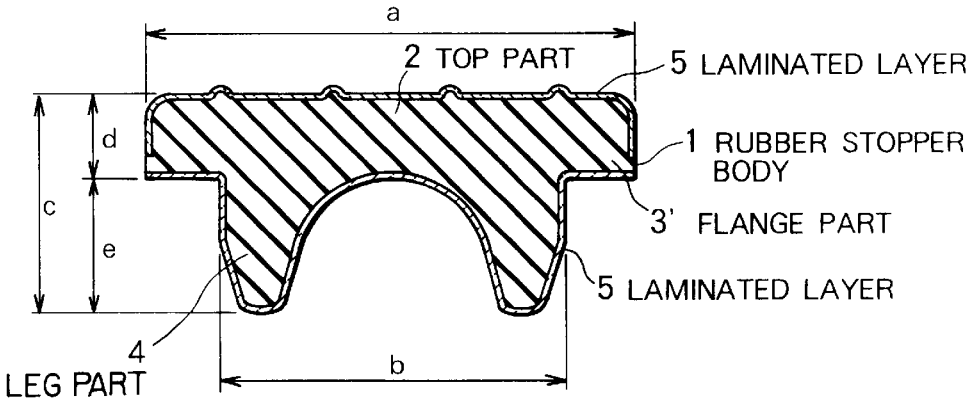
FIG. 3B PRIOR ART
Figure 3C:
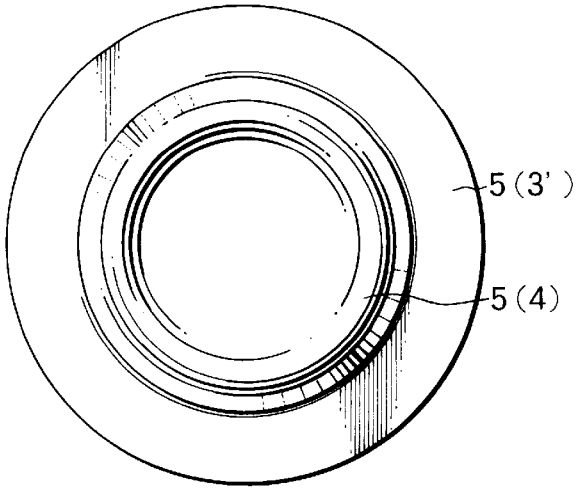
FIG. 3C PRIOR ART

One hundred samples of laminated rubber stoppers of the prior art were prepared, in each of which the whole surface of the lower side of the rubber stopper was laminated and the lower surface of the flange was flat, as shown in FIG. 3 (A), (B) and (C) being respectively a top view, cross-sectional view and bottom view, and inserted into vials and subjected to an air-leakage test in an analogous manner to Example 1. The results (average value of one hundred samples) are shown in Table 1. In FIG. 3, marks in common with FIG. 1 have the same meanings as FIG. 1 and 3' designates a flange part whose lower surface is concavity-free and plane-shaped. Dimension of a to e is the same as that of FIG. 1.

EXAMPLE 2

One hundred samples of laminated rubber stoppers according to the present invention were prepared in an analogous manner to Example 1 except retaining an exposed rubber surface from the lower surface of the flange part to the periphery of the base of the leg part, in FIG. 1, inserted into vials and subjected to an air-leakage test in an analogous manner to Example 1. The results (average value of one hundred samples) are shown in Table 1.

Comparative Example 2

Figure 5:
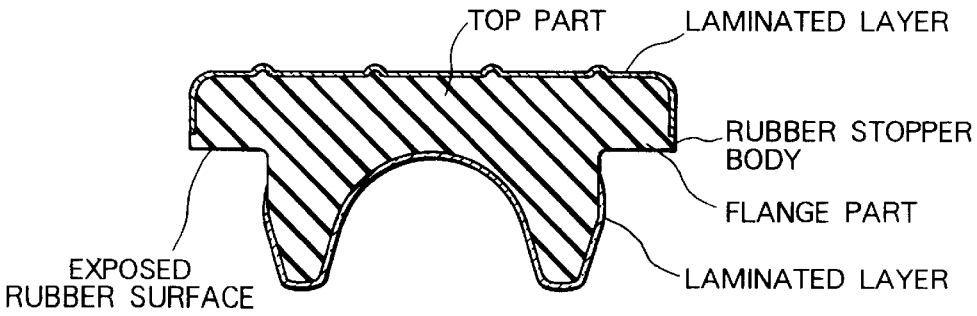
FIG. 5 PRIOR ART
FIG. 5 is a cross-sectional view of a laminated rubber stopper of the prior art such that the flat lower surface of the flange is not laminated and is retained as an exposed rubber surface and the other lower surface is laminated with a resin film.

One hundred samples of laminated rubber stoppers, as shown in FIG. 5, were prepared in an analogous manner to Example 2 except retaining an exposed rubber surface from the lower surface of the flange part to the periphery of the base of the leg part, in FIG. 3, inserted into vials and subjected to an air-leakage test in an analogous manner to Example 1. The results (average value of one hundred samples) are shown in Table 1.

TABLE 1

| | Example | | | | | | Comparative Example | | | | | |
|---|---|---|---|---|---|---|---|---|---|---|---|---|
| | 1 | | | 2 | | | 1 | | | 2 | | |
| Shape of Laminated Lower Surface | A* | | | B** | | | A* | | | B** | | |
| Central Value of Vial Inner Diameter (mm) | 12.3 | 12.5 | 12.7 | 12.3 | 12.5 | 12.7 | 12.3 | 12.5 | 12.7 | 12.3 | 12.5 | 12.7 |
| Test Results (average of 100 samples) | | | | | | | | | | | | |
| ① Just After Inserting (Torr) | 15 | 15 | 15 | 15 | 15 | 15 | 16 | 18 | 16 | 15 | 15 | 15 |
| ② After 24 Hours (Torr) | 21 | 21 | 21 | 17 | 17 | 17 | 277 | 318 | 478 | 19 | 19 | 19 |
| Difference ② - ① (Torr) | 6 | 6 | 6 | 2 | 2 | 2 | 261 | 300 | 462 | 4 | 4 | 4 |
| Judgement Presence of Leakage | no | no | no | no | no | no | yes | yes | yes | no | no | no |

(Note)
A*: Whole lower surface of rubber stopper laminated with fluoro resin film.
B**: Lower surface of rubber stopper laminated with fluoro resin film except having exposed rubber surface retained from lower surface of flange to base of leg part.

One hundred samples of each of the laminated rubber stoppers of Examples 1 and 2 and Comparative Examples 1 and 2 were tested according to the Elution Test Method of Japanese Patent Pharmacopoeia, 12th Revision. Distilled water was charged in a vial for 100 ml in such a manner that the leg part of the rubber stopper was brought into contact with the water in a proportion of 2 ml per 1 $cm^2$ of surface area, the vial was sealed by inserting the rubber stopper sample, fastened by an aluminum cap and heated at 121° C. for 60 minutes under inverted state in an autoclave. The liquid in the vessel was then used as a test liquid and subjected to the above described extraction test to obtain results as shown in Table 2. From these results, it is apparent that in the items of the extraction test, the laminated rubber stoppers of the present invention show very little elution and excellent sanitary property.

TABLE 2

| Test Items | Example 1 | Example 2 | Comparative Example 1 | Comparative Example 2 | Standard Value of 12th Revision, Japanese Pharmacopoeia |
|---|---|---|---|---|---|
| Extraction Test (average of 100 samples) Property (%) | | | | | |
| 430 nm | 100 | 99.9 | 100 | 99.9 | ≧99.9% |
| 650 nm | 100 | 100 | 100 | 99.9 | ≧99.9% |
| Foaming (min) | 0.5 | 0.5 | 0.5 | 0.5 | within 3 minutes |
| pH | 0.21 | 0.51 | 0.27 | 0.63 | difference: ≦1.0 |
| Zinc (ppm) | ≦0.1 | ≦0.1 | ≦0.1 | ≦0.1 | — |
| UV Absorption Spectrum | 0.001 | 0.031 | 0.003 | 0.053 | ≦0.20 |
| $KMnO_4$ Reducing Material (ml) | 0.21 | 0.40 | 0.23 | 0.48 | ≦2.0 ml |
| Distillation Residue (mg) | 0.1 | 0.4 | 0.2 | 0.6 | ≦2.0 mg |

Figure 4:
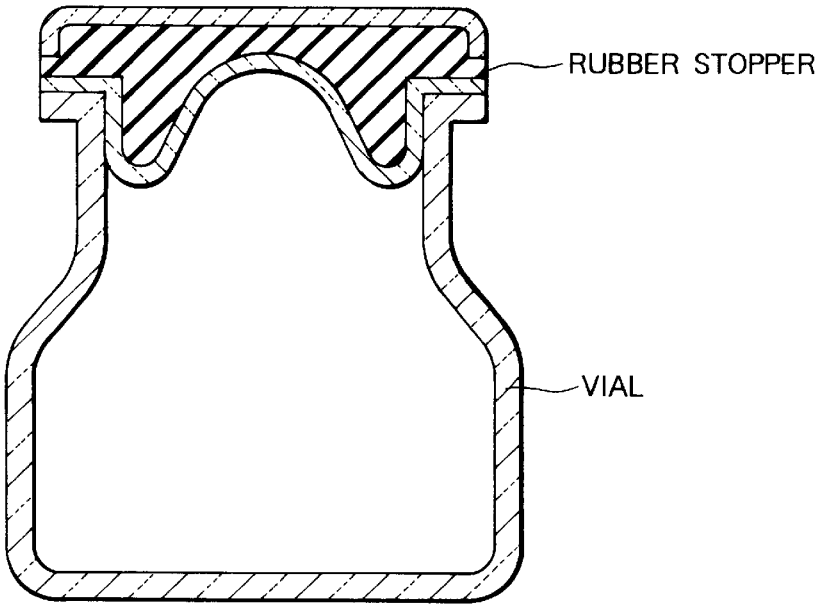
FIG. 4 is a cross-sectional view of a laminated rubber stopper inserted into an empty vial.

Furthermore, three samples of each of the laminated rubber stoppers of Example 1 and Comparative Example 2 were subjected to measurement of out-gases by gas chromatography. This test was carried out to measure a very small amount of an out-gas extracted in the head space of a vial from the rubber stopper. Specifically, as shown in FIG. 4, a rubber stopper sample was inserted in an empty 10 ml, vial fastened by an aluminum cap, and maintained in a drier at 100° C. for 1 hour. Then, 1000 $\mu$l of the gas in the vial was taken and subjected to gas chromatography analysis. Using detected peaks of these samples, the total amounts of the out-gases were obtained from the peak areas ($cm^2$) and compared to obtain results as shown in Table 3, in which a smaller area teaches a smaller amount of the out-gas.

It can be confirmed from the results of Table 3 that the sample of the present invention can favorably be compared with that of the prior art sample as to the decreased total amount of the out-gas and improved sanitary property.

The analysis by chromatography was carried out under the following conditions:

Gas chromatography manufactured by Shimazu Seisakusho Co., Ltd [Shimazu GC-144: FID dual detector—commercial name—], column: BENTONE 34+ DIDP (5 +5%), UNIPORT+HP 80/100 —commercial name—, glass column (3 mmø×3 m), feed part temperature: 105° C., column temperature: 70° C., detector temperature: 115° C., flow rate: $H_2$0.5 kg/$cm^2$, air 0.5 kg/$cm^2$, $N_2$42 ml/min, range: $10^2$.

TABLE 3

Gas Chromatography Test Results (total peak area: $cm^2$)

| | First Time | Second Time | Third Time | Average Value |
|---|---|---|---|---|
| Comparative Example 2 | 516 | 475 | 508 | 500 |
| Example 1 | 168 | 147 | 178 | 164 |

Advantages of the Invention

As illustrated above, the laminated rubber stopper of the present invention has great advantages on a commercial scale such that a problem of contamination from a raw rubber material can be solved and air-tightness can be secured by devising the lower surface of the flange part thereof and the cross-sectional shape of the neck part, whereby contents such as expensive and unstable medicaments, etc. can be stored without deterioration of the quality for a long time and the production can be carried out in simple manner to reduce the cost therefor.

What is claimed is:

1. An apparatus comprising a container and a stopper for the container, wherein the stopper is a laminated rubber stopper comprising a top part having a flange part, a leg part having a base, provided under the top part, insertable into a mouth part of the container, and a neck part which is a boundary between the flange part and the leg part, at least a surface of the stopper to be contacted with contents in the container being laminated with a fluoro resin film, in which the lower surface of the flange part has an annular concavity with a cross section of an arc from the periphery of the flange part to the neck part, the lower surface of the flange part is laminated with a fluoro resin film, and the mouth part of the container has a flange part with a flat surface; wherein the stopper, apart from the container, exhibits said annular concavity in the lower surface of the flange part, wherein when said stopper is completely engaged into the mouth of the container the material of the stopper maintains a shape without the application of an external force such that said annular concavity is not exhibited.

2. The apparatus as claimed in claim 1, wherein the whole surface of the leg part is laminated except the periphery of the base of the leg part adjacent the neck part.

3. The apparatus as claimed in claim 1, wherein at least the whole of the lower surface side of the rubber stopper is laminated with a fluoro resin film.

4. The apparatus as claimed in any one of claims 2, 3 or 1, wherein the annular concavity with a cross-section of an arc has an R of 0.05 to 0.5 mm in radius of curvature.

5. The apparatus as claimed in any one of claims 2, 3, or 1, wherein the neck part has an R of 0.01 to 0.4 mm in radius of curvature.

6. The apparatus as claimed in claim 4, wherein the neck part has an R of 0.01 to 0.4 mm in radius of curvature.

* * * * *